US008777097B2

(12) United States Patent
Jacomelli et al.

(10) Patent No.: US 8,777,097 B2
(45) Date of Patent: Jul. 15, 2014

(54) SET OF BLANKS, BOX AND BOX PRODUCTION METHOD

(75) Inventors: Sébastien Jacomelli, Laives (FR); Gérard Mathieu, Clergy (FR)

(73) Assignee: Otor, Puteaux (FR)

( * ) Notice: Subject to any disclaimer, the term of this patent is extended or adjusted under 35 U.S.C. 154(b) by 302 days.

(21) Appl. No.: 12/679,802

(22) PCT Filed: Sep. 4, 2008

(86) PCT No.: PCT/FR2008/001231

§ 371 (c)(1),
(2), (4) Date: May 13, 2010

(87) PCT Pub. No.: WO2009/066015

PCT Pub. Date: May 28, 2009

(65) Prior Publication Data

US 2010/0264200 A1 Oct. 21, 2010

(30) Foreign Application Priority Data

Sep. 28, 2007 (FR) ..... 07 06847

(51) Int. Cl.
*B65D 5/32* (2006.01)
*B31B 17/00* (2006.01)

(52) U.S. Cl.
USPC ..... 229/122.21; 229/125.01; 229/939; 493/84

(58) Field of Classification Search
CPC ..... B65D 5/326; B65D 5/4266; B65D 5/68; B65D 5/32; B31D 2217/082; B31D 2217/00
USPC ..... 229/122.3, 122.23, 122.24, 122.27, 229/920, 919, 937, 930
See application file for complete search history.

(56) References Cited

U.S. PATENT DOCUMENTS 3,643,856 A * 2/1972 Jones ..... 229/122.33
3,941,305 A * 3/1976 Chipp et al. ..... 229/125.13

(Continued)

FOREIGN PATENT DOCUMENTS

EP 0592939 A 4/1994
EP 0637548 A 2/1995

(Continued)

OTHER PUBLICATIONS

International Search Report dated Apr. 20, 2009.

*Primary Examiner* — Gary Elkins
*Assistant Examiner* — Christopher Demeree
(74) *Attorney, Agent, or Firm* — Banner & Witcoff, Ltd

(57) ABSTRACT

The invention relates to a set (22) of blanks for forming a packaging box, a method and a corresponding box. The set includes two corrugated board blanks, namely: a first blank (2') including flaps connected to one another by first fold lines (9'), one side of said blank having no folds; and a second blank (12') including panels (13', 14', 15', 16') connected to one another by third fold lines (19'), the panels of the second blank being stacked respectively on the part of the first blank having no folds. Two non-adjacent flaps (3', 5') of the first blank are glued to two respective facing panels (13', 15') of the second blank, thereby preventing the relative movement thereof during folding or during the formation of the box when the blanks are wound around a volume having predetermined dimensions. At least two-thirds of the third fold lines (19') of the second blank are substantially aligned in relation to the first fold lines of the first blank, the lower part (23) of one or more of said third lines including a cut or collapsed portion opposite the corresponding first fold line.

29 Claims, 9 Drawing Sheets

(56) References Cited

U.S. PATENT DOCUMENTS

| | | | | |
|---|---|---|---|---|
| 4,946,093 | A * | 8/1990 | Moorman | 229/125.19 |
| 5,016,753 | A * | 5/1991 | Henderson | 206/459.1 |
| 2003/0116615 | A1 * | 6/2003 | Hyatt et al. | 229/183 |

FOREIGN PATENT DOCUMENTS

| | | | |
|---|---|---|---|
| EP | 0785138 | A | 7/1997 |
| EP | 1371567 | A | 12/2003 |

* cited by examiner

SET OF BLANKS, BOX AND BOX PRODUCTION METHOD

The present invention relates to a set of blanks for forming a packaging box of the type comprising two blanks made of cardboard sheet material, at least one of them being made of corrugated cardboard, namely a first blank including a first series of at least four main flaps terminated by a fixing tab, connected to one another by first fold lines parallel to one another, directly or via intermediate flaps, and provided on one side with a series of flaps connected to said first series of flaps by second fold lines perpendicular to said first fold lines and without flaps on the other side, said first series of flaps being designed to form the walls of the base of the box and a second blank including a second series of at least four panels connected to one another by third fold lines parallel to one another, said second blank being designed to form the lid of said box, the panels of the second blank being respectively stacked on the part without flaps of the flaps of the first blank.

It also relates to a box obtained with such a set of blanks, and the method for producing such a box.

It is particularly applicable, although not exclusive, to the field of corrugated cardboard reinforced boxes, and the field of boxes or packages made of corrugated cardboard ready for sale, that is to say intended to remain at least partly on the shelves of supermarkets.

Packages with flaps in two pieces obtained from two blanks are already known.

These two-part packages allow for subsequent separation, a part of the package then remaining, for example as a display.

To obtain such packages, the outer blank needs to have a perimeter greater than that of the inner blank since it is used as an overthickness.

A first solution consists in using the outer blank to cover the previously glued inner blank, which is complicated, and cannot be done at high speed (more than twenty cases per minute).

Another solution consists in previously gluing the two blanks to one another before folding them at 180° to deliver them folded and joined, or deliver them flat for covering.

However, there is then, necessarily, at the moment of folding to 180° or covering, a very high tension between the blanks, often causing glue spots to break, or the cardboard blanks to tear, or the internal wall of the box to be deformed unacceptably.

To solve this problem, packages were first proposed (EP 0 637 548) that had a lid or internal belt having large wide indentations at the base of the corner of the side walls.

These indentations are used in effect to take up the gaps when folding or covering by the cardboard manufacturer.

However, such a solution on the one hand generates a significant loss of compression (25% to 30%) and on the other hand results in a less good rigidity of the package.

It is then necessary to increase the basis weight of the paper and consequently the cost of the package.

Also proposed (EP 0 876 281) is a package comprising a device for taking up the gaps by sliding between the blanks when folding or covering.

While such a solution is satisfactory in many respects, it does, however, require the use of elastic or delayed seizing glues, or even a frangible part, allowing a relative movement between blanks in their bond line. Now, such a solution can be difficult to implement with some types of cardboard, notably cardboard of low basis weight.

The present invention makes it possible to overcome these drawbacks.

It aims to provide a set of blanks, a box and a method of producing boxes that meet the requirements of the practice better than those previously known, notably in that it allows for an automatic effective and rapid assembly of the boxes virtually without generating waste, at high speeds (more than thirty boxes per minute).

The boxes obtained exhibit great rigidity and an excellent resistance to compression and destruction.

The invention thus meets the supermarket distribution demand, which for many years has been seeking packages that can be placed directly on aisle shelves allowing for a good presentation of the products, from traditional blanks and not requiring a complicated or excessively difficult production method.

The set of blanks and the box according to the invention meet this demand by proposing a package in two parts, that can be formed on the same machines as those used currently by packagers, not requiring sophisticated blanks and/or particular glue, and do so while retaining high rates, even with low basis weights.

An excellent resistance to compression and good solidity of the package is maintained throughout the logistics distribution phase, the design of the box moreover allowing for an optimized presentation of products by simply tearing the lid at the moment of sale.

To this end, the invention notably proposes a set of blanks for forming a packaging box comprising two blanks made of cardboard sheet material, at least one of them being made of corrugated cardboard, namely a first blank including a first series of at least four main flaps terminated by a fixing tab, connected to one another by first fold lines parallel to one another and provided on one side with a series of flaps connected to said first series of flaps by second fold lines perpendicular to said first fold lines and without flaps on the other side, said first series of flaps being designed to form the walls of the base of the box and a second blank including a second series of at least four panels connected to one another by third fold lines parallel to one another, said second blank being designed to form the lid of said box, the panels of the second blank being respectively stacked on the part without flaps of the flaps of the first blank, characterized in that two non-adjacent flaps of the first blank are glued respectively to two opposite panels of the second blank, preventing the relative movement thereof when folding or forming the box by winding said blanks around a volume of predetermined dimensions, and in that at least two out of three of the third fold lines of the second blank are substantially aligned in relation to the first fold lines of the first blank, one or more of said third lines including, in the bottom part, a cut or collapsed portion opposite the corresponding first fold line.

The expression "cut portion" should be understood to mean a portion that is incised or slotted through for example by a cutting blade or knife, from end to end, with no material removed, or in one embodiment, substantially without the removal of material (that is to say with a slot less than one or two millimeters wide), unlike the indentations of the prior art.

The expression "substantially aligned" should be understood to mean aligned (for example because of the crumpling of the groove of the fold line) or in the more particularly envisaged embodiment, slightly offset relative to the opposite fold line by a value corresponding at least to the aggregate value of the thicknesses of the papers forming the blanks, but still very small, that is to say by a value less than about 1 or 2 mm, or as specified hereinbelow for example, by 0.5 to 0.7 mm between grooves.

The fold lines according to the embodiments of the invention more particularly described are simple lines, that is to say whose groove forms an edge whose peak is unilinear.

The expression "gluing to prevent relative movement" should be understood to mean gluing preventing movement in the direction of the plane of the flaps and panels, without tearing and separating.

However, such gluing may allow for subsequent separation of the elements of the duly formed box by manually tearing transversely one relative to the other, to release the lid from the tray-forming base.

In advantageous embodiments, there is also recourse to one or more of the following arrangements:

the two blanks are made of corrugated cardboard;

all the third fold lines between panels include a cut or collapsed portion in the bottom part;

the portion or portions of third fold lines substantially aligned with the first fold lines and situated opposite said first fold lines are cut;

the blank is crosshead-shaped;

the blank is T-shaped;

the cut portion or portions are offset from the rest of the corresponding third fold line toward the panel glued to the facing flap;

this offset is produced on the side opposite to the panel glued to the facing flap;

the thickness of the cardboard of the base being E2 and that of the cardboard of the lid being E1, the base being fixed to the outside of the lid, the portion is cut and its offset is substantially less than ⅓ E1+⅔ E2.

The term "substantially less" should be understood to mean at least two times less;

the thickness of the cardboard of the base being E2 and that of the cardboard of the lid being E1, the base being fixed to the inside of the lid, the offset is substantially less than ⅔ E1+⅓ E2;

the portion or portions of third fold lines substantially aligned with the first fold lines and situated opposite said first fold lines are collapsed;

the thickness of the cardboard of the base being E2 and that of the cardboard of the lid being E1, the collapsing is done over a width greater than 2×(E1+E2);

the cut or collapsed portion of the third fold line or lines extends beyond the edge without flaps of the first blank, for example by a distance of 0.5 mm to 2 mm;

the bottom edge of the second blank being opposite, or substantially opposite the second fold lines, the cut or collapsed portion or portions extend upward over a length a little greater than the height of the flaps of the first blank. The expression "a little greater" should be understood to mean of the order of 1 to 2 mm more, to be beyond the edge of the blank by that distance;

the first blank has eight flaps, namely four main flaps separated from one another by intermediate flaps designed to form cut corners of the box. In this case, there are seven fold lines between flaps, and not three as in a four-sided package. The number of third fold lines, substantially aligned with the first fold lines, is then greater than two out of three, and for example at least five out of seven;

the second blank includes a series of flaps connected to the panels by fourth fold lines perpendicular to the third fold lines;

the second blank includes a fixing tab connected to the adjacent panel by a third fold line and extending along a part only of the corresponding adjacent panel, facing a part of, or offset in relation to, the fixing tab of the first blank;

the second blank includes a fixing tab connected to the adjacent panel by a third fold line and situated on the side opposite to that of the fixing tab of the series of flaps of the first blank, outside of said first blank;

the second blank includes a fixing tab connected to the adjacent panel by a third fold line, situated on the same side and opposite the fixing tab of the series of flaps of the first blank, and wider;

the first blank is situated or arranged to be situated outside the second blank when the box is formed;

the first blank is situated or arranged to be situated inside the second blank when the box is formed.

The invention also proposes a box obtained with the set of blanks as described hereinabove.

Such a box is rigid, not foldable except by destroying it.

It also makes it possible to obtain a packaging box with polygonal section, formed from two blanks made of cardboard sheet, at least one of which is made of corrugated cardboard, namely a first blank including a series of at least four main flaps terminated by a fixing tab, connected to one another by first fold lines parallel to one another, said series of flaps forming the walls of the base of the box and being connected on one side to a series of flaps by second fold lines perpendicular to said first fold lines, said series of flaps forming the bottom of said box, and having no flaps on the other side, and a second blank including at least four panels connected to one another by third fold lines parallel to one another, said second blank forming the lid of said box, the panels of the second blank being respectively stacked on the part without flaps of the flaps of the first blank, characterized in that two non-adjacent flaps of the first blank are glued respectively to two opposite panels of the second blank, preventing the relative movement thereof when folding or forming the box by winding said blanks around a volume of predetermined dimensions, and in that at least two out of three of the third fold lines of the second blank are substantially aligned in relation to the first fold lines of the first blank, one or more of said third fold lines including in the bottom part a cut or collapsed portion opposite the corresponding first fold line.

Advantageously, the blank of the cut portions is crosshead-shaped or T-shaped.

In another advantageous embodiment, the cut portion or portions is/are offset from the rest of the corresponding third fold line, for example by a value substantially less than ⅓ E1+⅔ E2 (the thickness of the cardboard of the base being E2 and that of the cardboard of the lid being E1), for example by approximately 0.4 to 0.8 mm.

Also advantageously, the portions of third fold line are collapsed, the collapsing being, for example, done over a width greater than 2×(E1+E2), and advantageously over about 10 mm.

In an advantageous embodiment, the cut or collapsed portion of the third fold line or lines extends beyond the edge without flaps of the first blank.

The invention also proposes a method for producing a packaging box with polygonal section of the type described hereinabove, and/or from a set of blanks as described hereinabove.

The invention also proposes a method for producing a packaging box with polygonal section from two blanks made of corrugated cardboard sheet, namely a first blank including a series of at least four main flaps terminated by a fixing tab, linked to one another by first fold lines parallel to one another, said series of flaps forming the outer walls of the base of the box and being connected on one side to a series of flaps by second fold lines perpendicular to said first fold lines, said series of flaps forming the bottom of said box, and a second blank including at least four panels connected to one another by third fold lines parallel to one another, said second blank forming a lid for said box, characterized in that at least two out of three of the third fold lines of the second blank being substantially spaced apart by the same distances as those spacing apart the first fold lines of the first blank, one or more of said third fold lines are cut and/or collapsed in the bottom part over a portion arranged to be positioned opposite the one or more corresponding first fold lines, two non-adjacent flaps or panels are glued, the second blank is placed on the first blank, the portion or portions of the cut and/or collapsed third fold line or lines of the second blank being substantially aligned in relation to the first fold lines of the first blank, the second blank is then applied to the first blank, or vice versa, to glue the two non-adjacent panels and flaps, and the box is formed by winding the blanks around a predetermined volume, with no sliding of the second blank relative to the first blank, the cuts or collapsing done on the portions of third fold lines allowing for the formation without folds, collapsing or tearing of the flaps and panels of the box.

Advantageously, the cut and/or collapsed portion of the third fold line or lines is formed in such a way that it extends after gluing beyond the edge without flaps of the first blank.

In an advantageous embodiment, the portions of third fold lines are cut in the shape of a crosshead or in the shape of a T.

Advantageously, the cut portion or portions are offset from the rest of the corresponding third fold line, for example toward the panel glued to the facing flap.

In an advantageous embodiment, the offset is of the order of 0.4 to 0.8 mm.

Also advantageously, the portion or portions of third fold lines opposite the first fold lines are collapsed, for example, over approximately 10 mm.

The invention will be better understood from reading the following description of embodiments given hereinbelow by way of nonlimiting examples.

It refers to the accompanying drawings in which.

Figure 7:
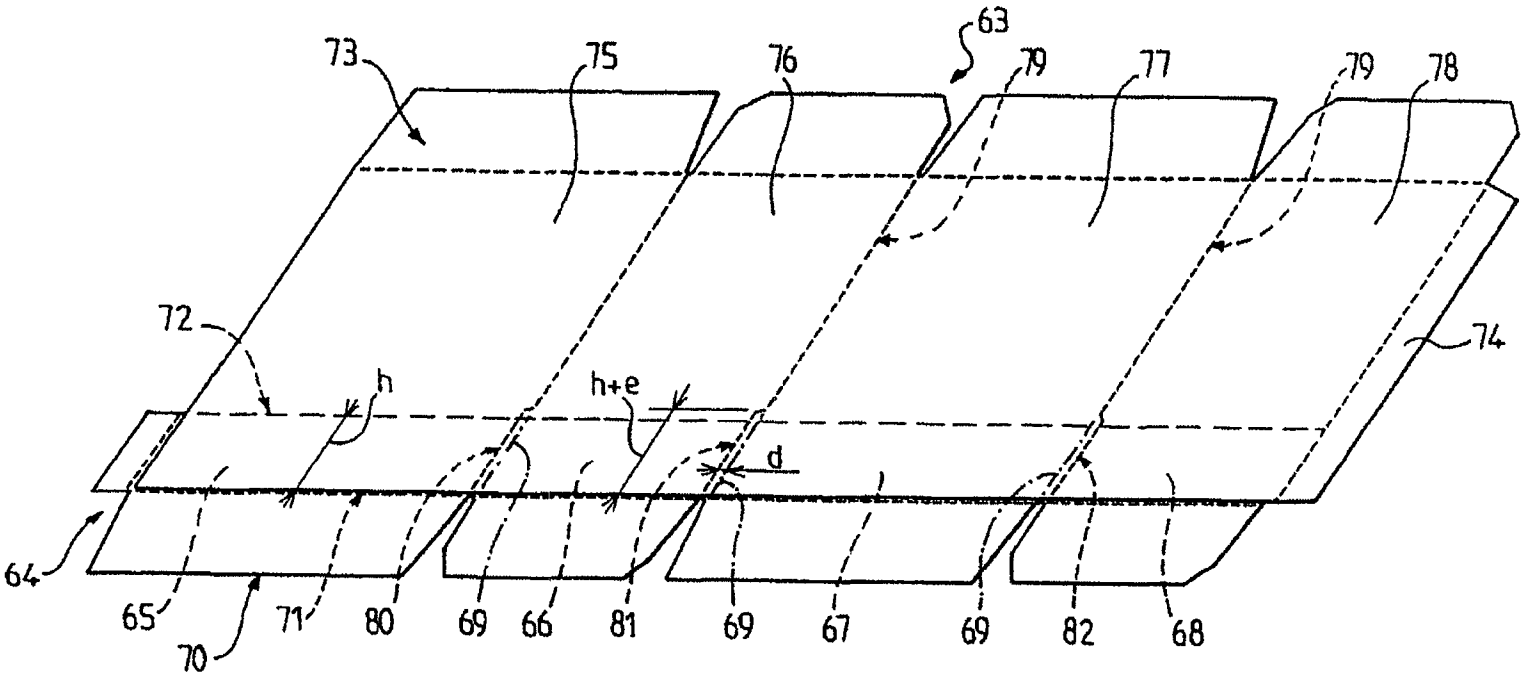
Figure 8:
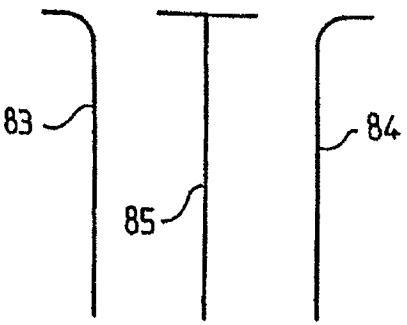

FIGS. 7 and 8 respectively show a perspective view of an embodiment of a set of blanks according to the invention, and exemplary cut portions.

Figure 10:
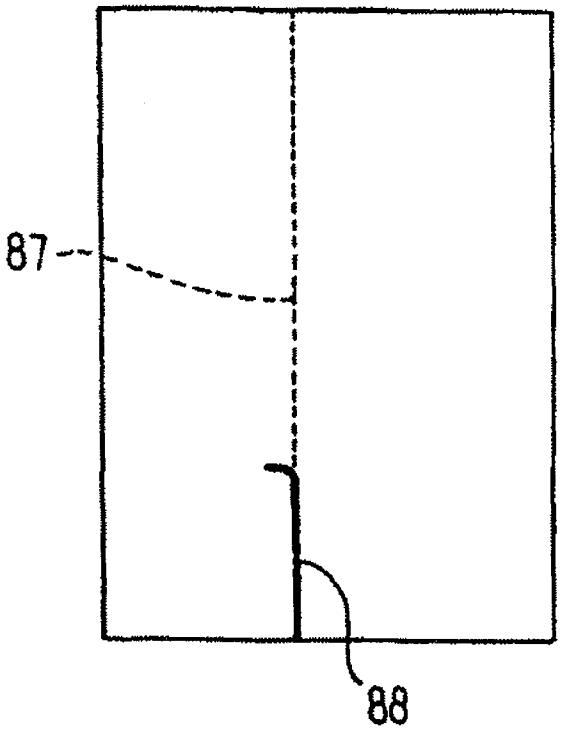
Figure 9:
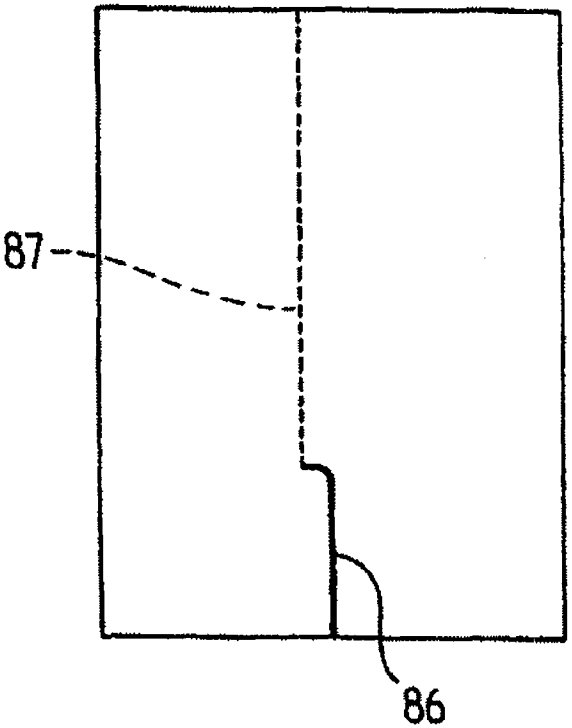

FIGS. 9 and 10 show two embodiments of crosshead-shaped blanks according to the invention.

Figure 11:
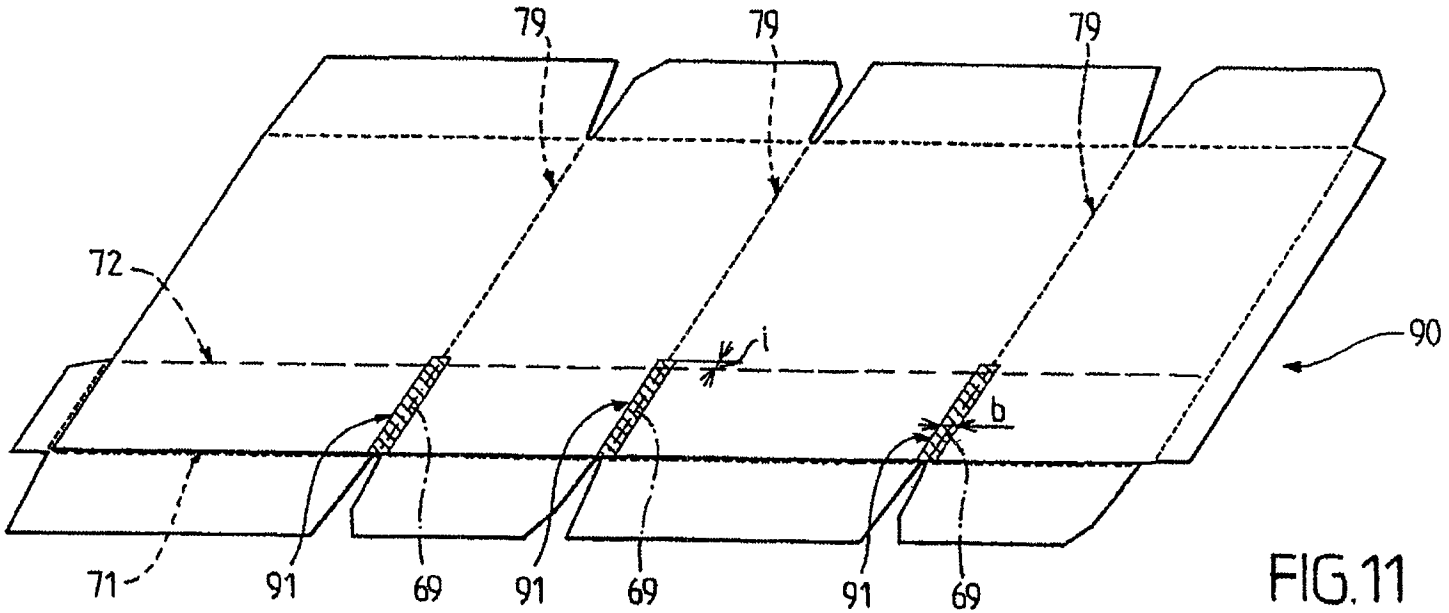

FIG. 11 is a plan view, in perspective, of another embodiment of a set of blanks according to the invention, with collapsing.

Figure 12:
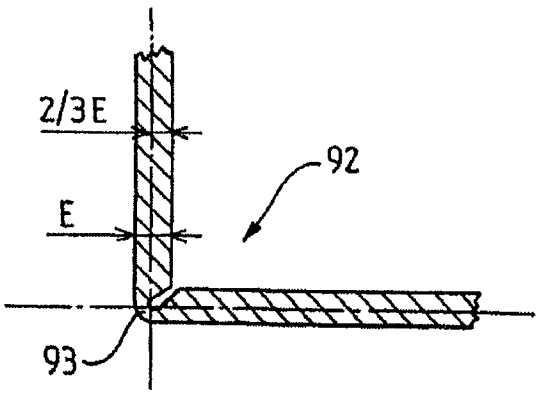

FIG. 12 is a cross-sectional view of a 90° fold of a corrugated cardboard blank.

Figure 13:
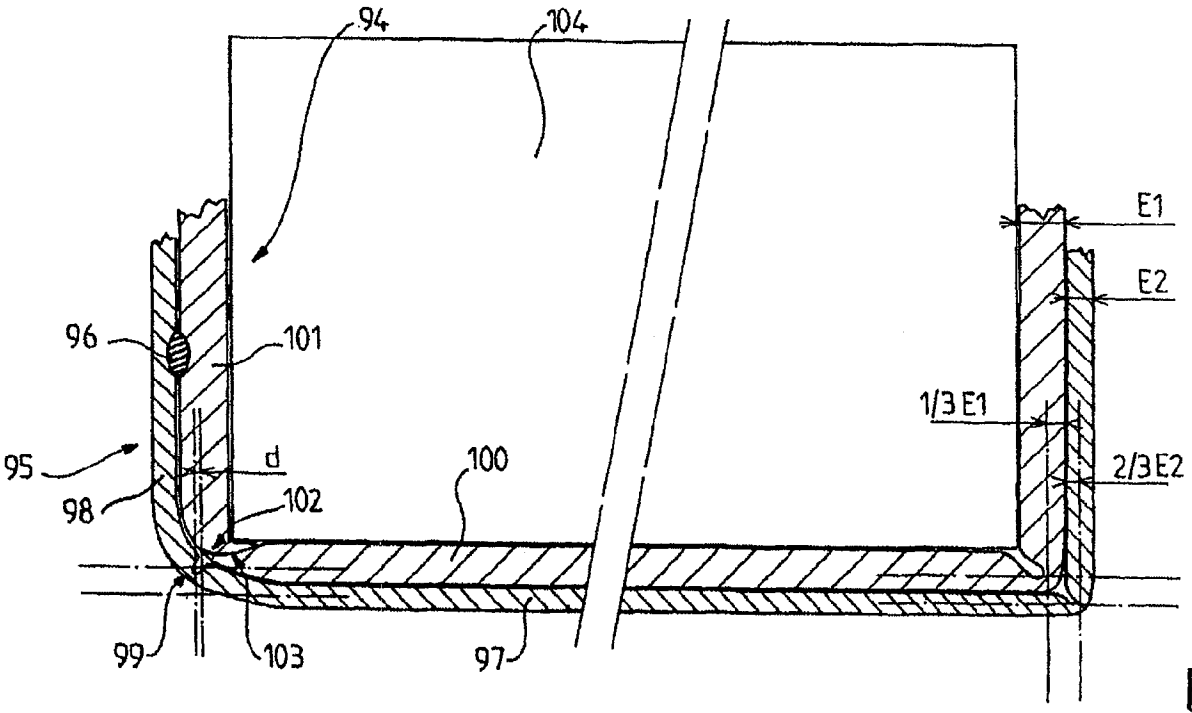
Figure 14:
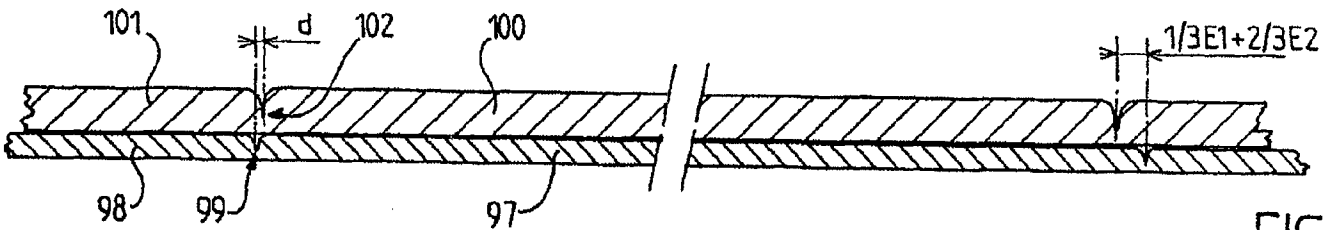

FIGS. 13 and 14 show in cross section two stacked blanks, respectively before folding and after folding, on one side at the level of a portion of third fold line that is cut or collapsed, when the fold lines are substantially facing, without sliding, according to the invention, and the other side when sliding is allowed.

Figure 1:
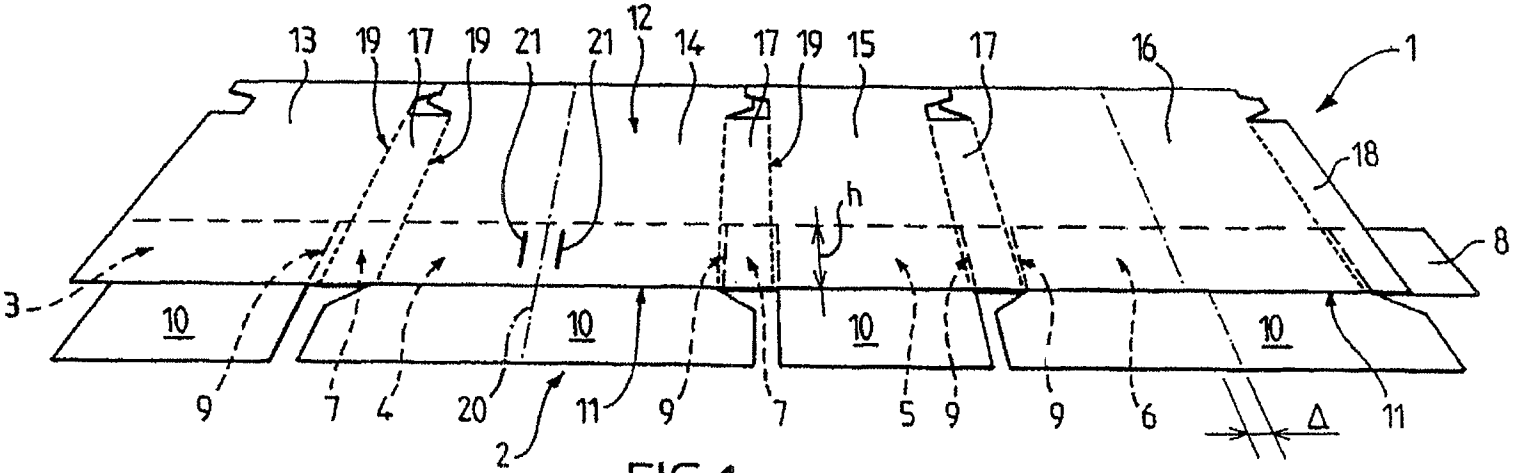
FIG. 1 shows a plan view in perspective of a set of blanks not conforming to the invention, with offset fold lines, to allow the sliding.

FIG. 1 shows a set 1 of blanks for eight-sided boxes, with conventional gluing, that is to say on just one side, before covering around a mandrel allowing relative sliding between blanks.

More specifically, the set of blanks 1 includes two blanks made of corrugated cardboard, namely a first blank 2 including a first series of four main rectangular flaps 3, 4, 5, 6 separated by intermediate rectangular flaps 7 of smaller width, and terminated by a fixing tab 8. The flaps and the tab are connected to one another by first fold lines 9 parallel to one another.

The series of flaps is, moreover, provided on one side with a series of flaps 10, respectively connected to the main flaps by second fold lines 11, perpendicular to the first fold lines.

The flaps of the first blank are of a first height h called small height, for example 5 cm.

They are without flaps on the other side and designed to form the walls of the base of the box.

A second blank 12 including a second series of at least four main rectangular panels 13, 14, 15, 16, separated by intermediate rectangular panels 17, are connected to one another and with a tab 18, by third fold lines 19, parallel to one another, and designed to form the lid of the box.

The panels of the second blank are respectively stacked on the corresponding flaps of the part without flaps of the first series of flaps of the first blank.

In this embodiment with sliding according to the prior art, the axis 20 of the covering mandrel is also shown, the face of which is applied to the single glued pair, formed from the panel 14 and the flap 4 (glue lines 21).

It can then be seen that, to allow for the covering, the first fold lines 9 and the third fold lines 19 must be increasingly offset, during covering, to allow for the plays of the outer blank relative to the inner blank to be taken up.

This results in a significant final offset Δ, at the level of the last flap 6, that can correspond to several thicknesses of cardboard, that is to say several millimeters, for example 4 to 8 mm.

Figure 2:
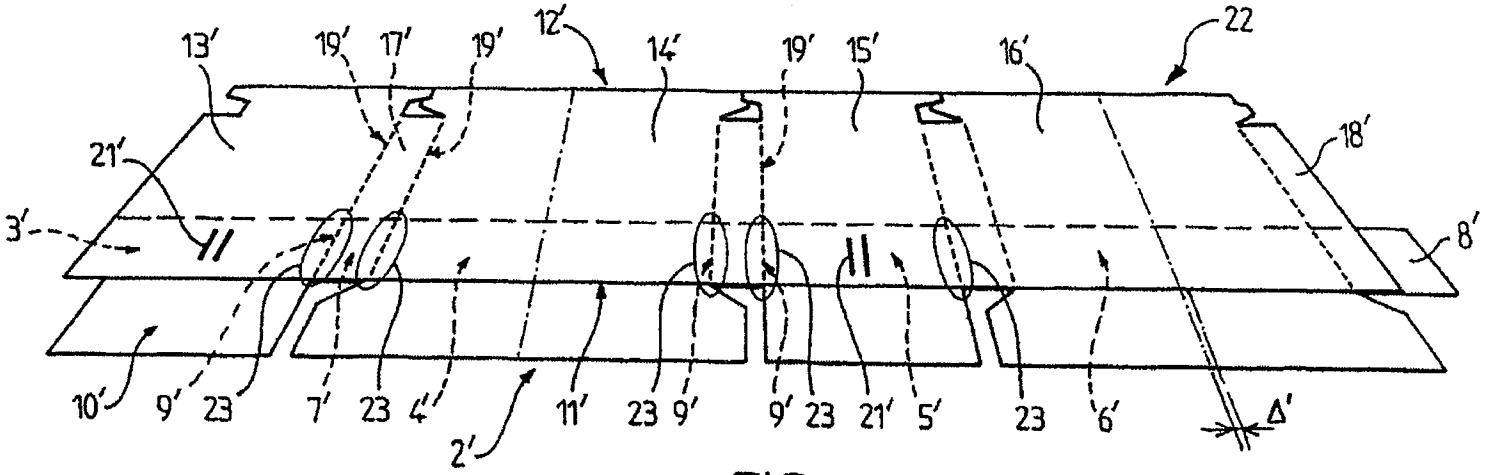
FIG. 2 shows a plan view in perspective of a set of blanks without offset fold lines, for folding or covering around a mandrel without sliding according to the present invention.

FIG. 2 then represents a set 22 of blanks, this time according to an embodiment of the invention.

Hereinafter, the same reference numbers are used to denote identical or similar elements, possibly assigning them an index.

The set 22, like the set 1, includes two blanks made of cardboard material, at least one of which is corrugated cardboard.

More specifically, it includes a first blank 2' including a first series of at least four main flaps 3', 4', 5' and 6', separated by intermediate flaps 7', and terminated by a fixing tab 8', the flaps and the tab being connected to one another by first fold lines 9', parallel to one another.

The series is provided on one side with a series of flaps 10' connected to the first series of flaps by second fold lines 11' perpendicular to the first fold lines, and is without flaps on the other side.

This first series of flaps is designed to form the walls of the base of the box which will be produced with this set.

A second blank 12', including a second series of at least four main panels 13', 14', 15', 16', separated by intermediate panels 17', and provided with an end tab 18', is provided to form the lid of the box.

The panels and the tab are connected to one another by third fold lines 19', parallel to one another, the panels of the second blank 12' being stacked on the part without flaps of the flaps of the first blank 2'.

According to the invention, two non-adjacent flaps, in this case the flaps 3' and 5', are glued respectively to the facing panels 13' and 15', via two lines 21' of glue (for example of glue known as "hot melt" glue).

At least two out of three of the third fold lines 19', and in this case five out of seven in this eight-sided package, namely the third fold lines situated between the successive panels 13', 17', 14', 17', 15', 17' of the second blank, are substantially aligned in relation to the corresponding first fold lines 9' of the first blank.

The fold lines 19' of this second blank will be detailed hereinbelow. It has already been stated that at least two out of three of these third fold lines 19' include, in the bottom part (area 23), cut or collapsed portions opposite the corresponding first fold lines.

When the covering is to be done, the top two panels and flaps being glued, the offset Δ' at the level of the last covered flap, which depends on the cardboard used, becomes very small (less than or equal to ½ thickness of cardboard, for example less than 1.5 mm) for cardboard 3 mm thick.

Figure 3A:
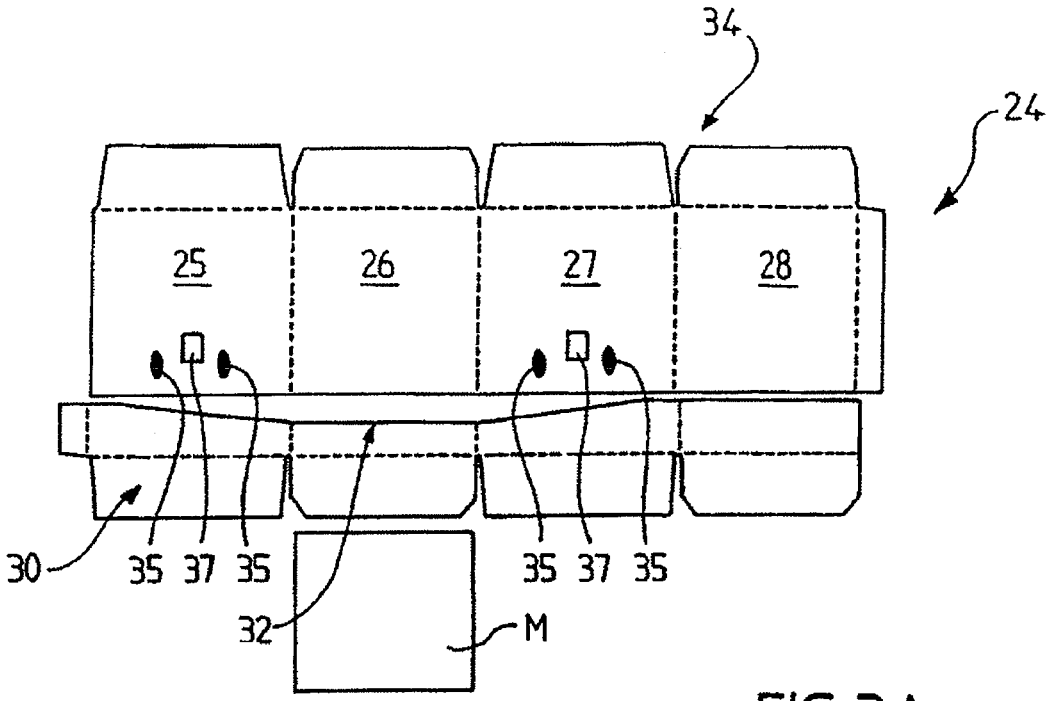
FIGS. 3A and 3B are flat plan views of blanks according to the invention showing the two types of gluing possible in case of covering around a mandrel, namely a gluing on both sides of the mandrel (FIG. 3A), and a gluing above and below the mandrel (FIG. 3B).
Figure 3B:
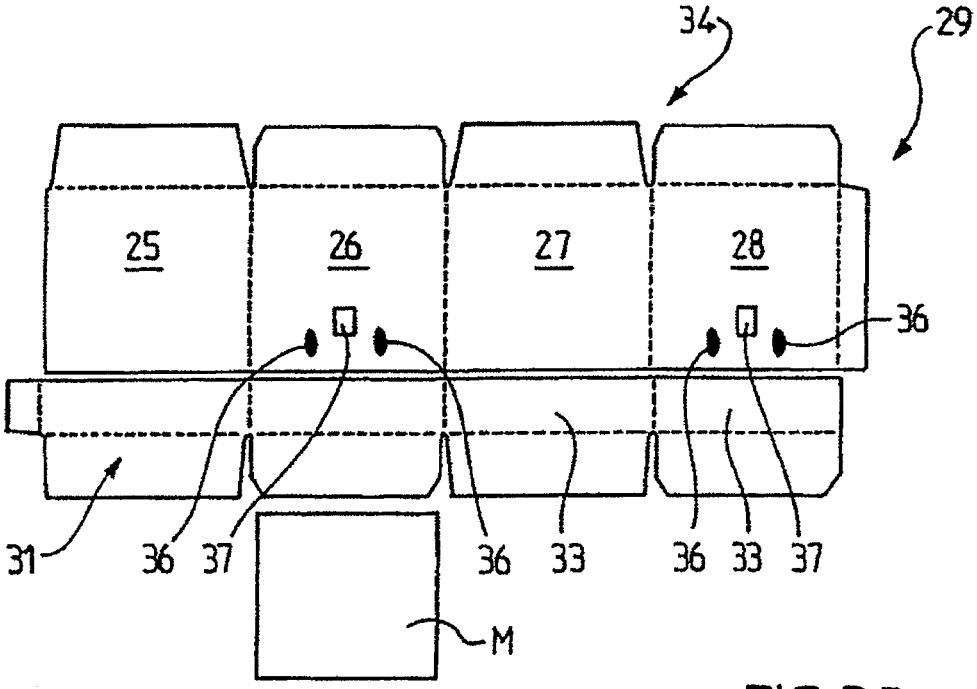

FIGS. 3A and 3B show two embodiments of sets of blanks according to the invention, one 24 with gluing on the two panels 25, 27 that will be pressed onto the lateral faces of the mandrel M (FIG. 3A) and the other 29 representing a gluing that will be done on the faces 26, 28 situated above and below the mandrel (FIG. 3B).

The first blanks 30 and 31 of these two sets can have different shapes depending on the type of base that is to be obtained on the shelves.

In FIG. 3A, the first blank includes a part 32 of smaller height, making it possible to present a front panel that better shows the products when they are presented.

FIG. 3B shows a first more conventional blank, with rectangular flaps 33.

Finally, the second blanks have in this case, in a manner known in itself, a second series 34 of substantially rectangular flaps, designed to form the top of the lid.

Their other side is, as in all the sets of blanks according to the invention, without flaps on the side of the first blank. The gluing is done at 35 on the rectangular flaps 25 and 27 for FIG. 3A, and at 36 on the rectangular flaps 26 and 28 for FIG. 3B, the last flap (free to be folded without constraint) then being, in one case (FIG. 3A), the flap on top of the mandrel, and in the other case (FIG. 3B), a lateral flap.

Advantageously, orifices 37 are provided to assist in the separation of the tray-forming bases, in a known way when the products are placed on a shelf.

Figure 4:
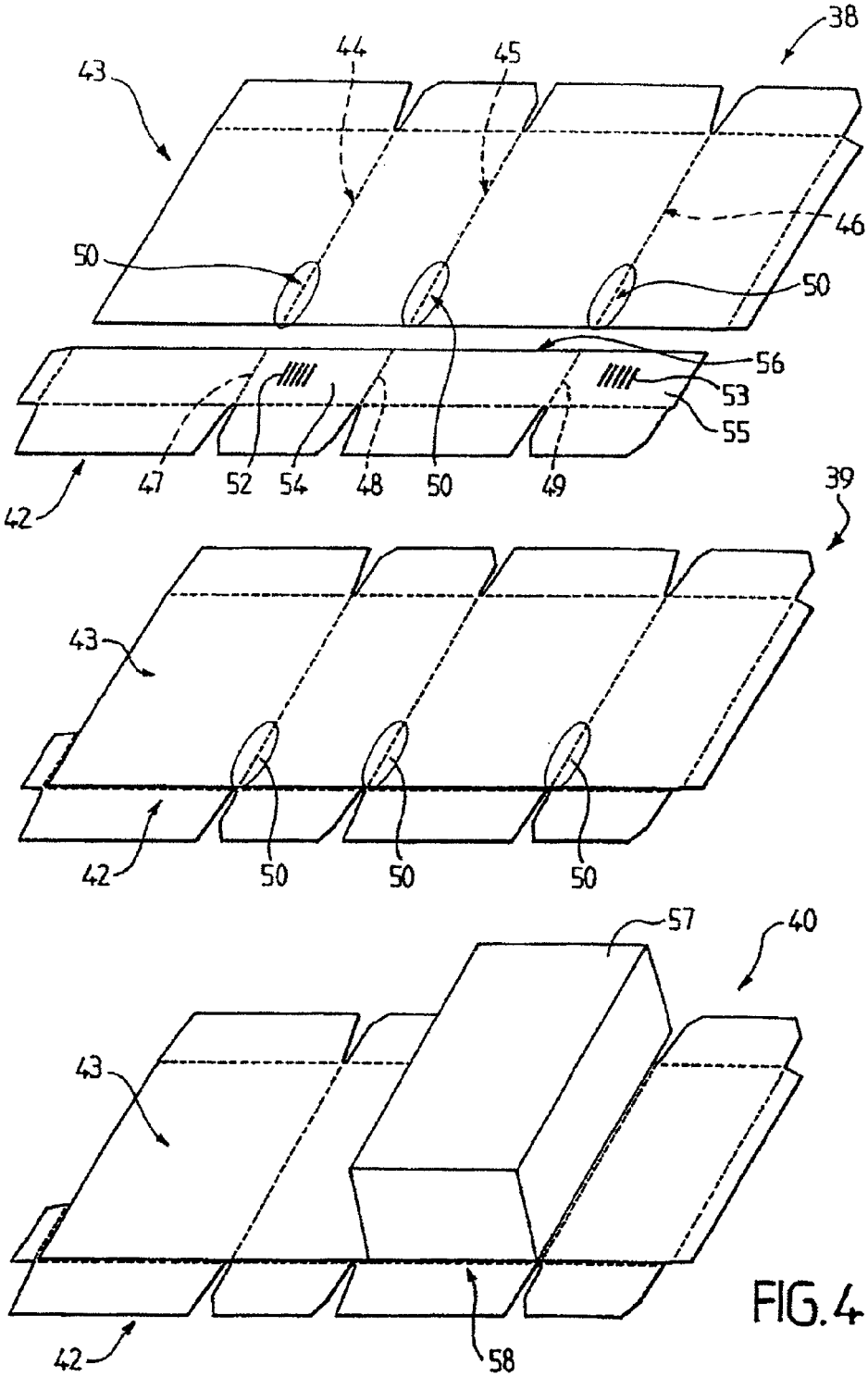
FIGS. 4 and 5 show in perspective the steps in forming a box according to one embodiment of the invention around a mandrel.
Figure 4A:
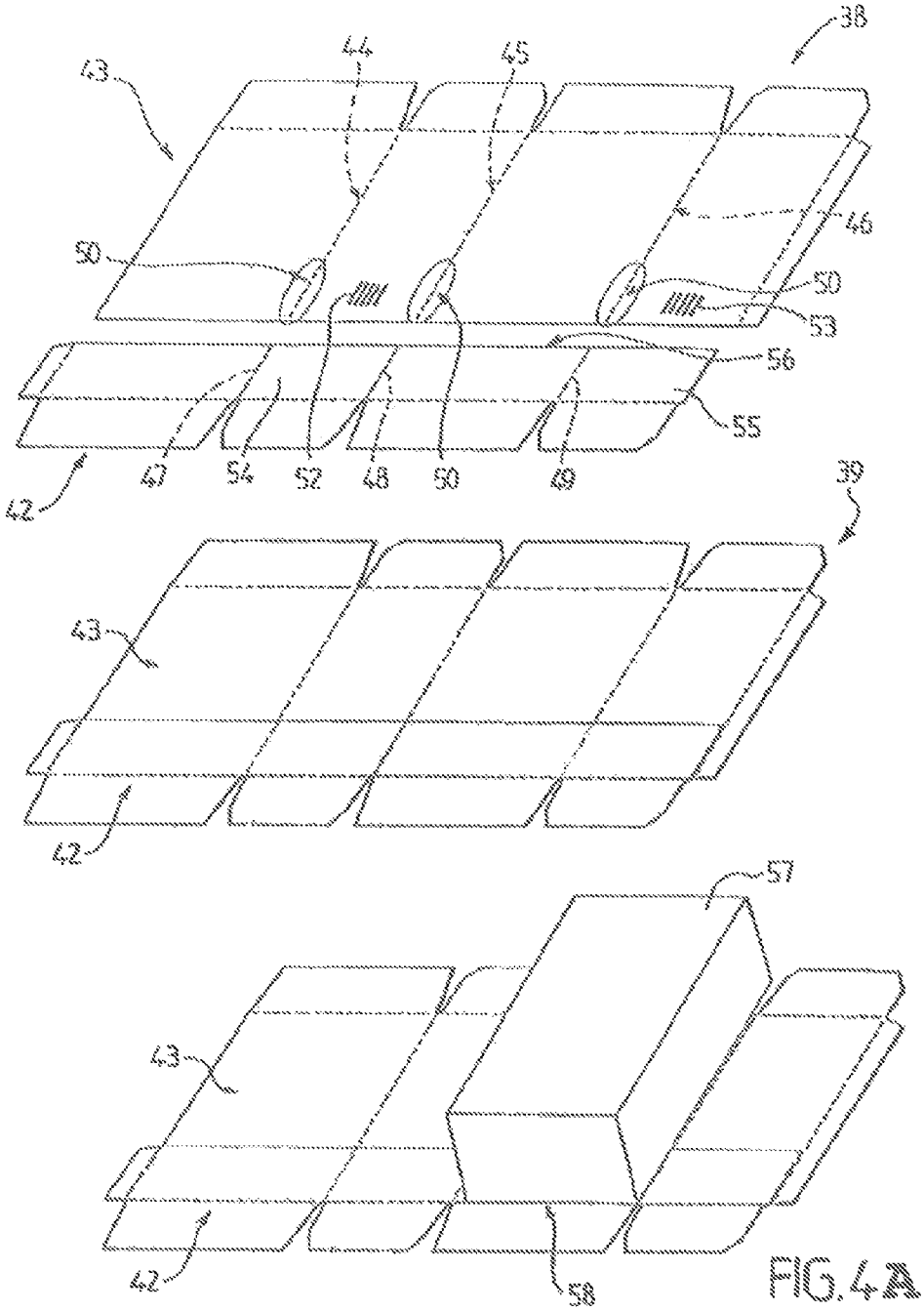
Figure 5:
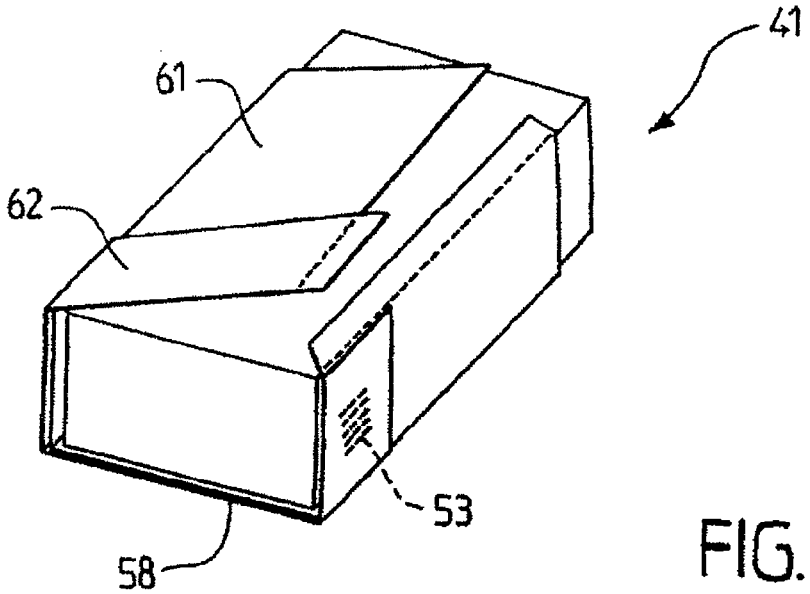

FIGS. 4 and 5 show the steps 38, 39, 40 and 41 in producing a box from a set of second blanks 42 and 43 according to the invention.

The three third fold lines 44, 45 and 46 are spaced apart substantially by the same distances as those spacing apart the first fold lines 47, 48, 49 of the first blank.

The three third fold lines are then cut and/or collapsed in the bottom part (at 50), over the portions arranged to be placed facing the corresponding first fold lines.

Then, two non-adjacent opposite flaps 54 and 55 are glued (glue lines 52 and 53). The second blank is then placed on the first blank, the three cut or collapsed fold lines of the second blank 43 being substantially aligned in relation to the first fold lines of the first blank.

There follows a stacking of the cut or collapsed areas 50 of the third fold lines 44, 45, 46 with the first fold lines 47, 48, 49 over their entire height, and, in one embodiment, over a slightly greater height, so that said areas extend above the edge 56 without flaps of the first blank 42.

The second blank is then applied to the first blank (step 39) to join together the two panels and the two non-adjacent flaps so that any translational movement in the direction of the plane of the blanks will be made impossible without destroying, that is to say without tearing and/or separating, one of the two cardboard pieces.

This assembly of blanks is then positioned under a mandrel 57, in this case under a non-glued side 58, and the assembly of blanks is folded down (FIG. 5) by winding it around the predetermined volume of the mandrel, without sliding the second blank in relation to the first blank, except at the level of the last panels 61 and flap 62, one side of which remains free.

The cuts or collapsing applied to the portions of the third fold lines according to the invention then allow for formation without bending, collapsing or tearing of the flaps and panels of the box.

Figure 6:
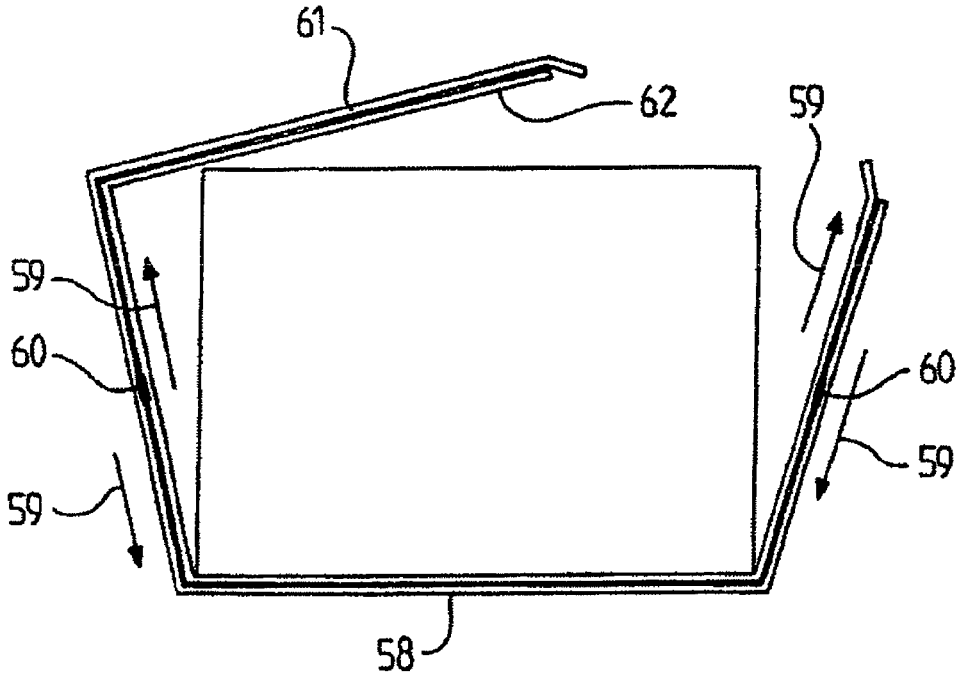
FIG. 6 shows, in cross section, the box of FIG. 5 and the stresses that are exerted during covering.

It can be seen in FIG. 6 that, during covering, strong shear tensions and forces (arrows 59) will be exerted on the glue lines 60.

However, there is no tension and therefore natural slippage of the last panels 61 and corresponding flap situated above the mandrel, in the embodiment described, and not glued to one another.

It can be seen that the normal consequences, if the means described in the invention were not implemented, would be either a breaking of the glue lines, or a tearing in the corners, or an appearance of folds on the internal belt.

Thanks to the modifications to the bottom portions of the third fold lines (cut and/or collapsing), a mashing of the cardboard is obtained during the covering and/or taking up of the gaps at the level of the fold itself, over a distance corresponding to the length of the cut line and/or of the mashing, a distance that is greater than or equal to the height of the facing base.

FIG. 7 shows a perspective view of a set 63 of blanks, namely a first blank 64 comprising four rectangular flaps 65, 66, 67, 68 that are linked to each other by first fold lines 69, and linked to a series of flaps 70, by second fold lines 71. The flaps have a height $\underline{h}$ between their edge without flaps 72 and said second fold lines 71.

The set comprises a second blank 73 with four rectangular panels 75, 76, 77, 78 linked to each other by third fold lines 79, respectively comprising a bottom portion 80, 81, 82 with a height $\underline{h}+\underline{e}$ with $\underline{e}$=1 or 2 mm cut in crosshead configuration.

More specifically, the three bottom portions 80, 81 and 82 of the three third fold lines 79 are cut by a single vertical cut line in the form of a crosshead or inverted L, with a slight offset $\underline{d}$ of around 1 mm, toward the panel 75 for the portion 80, toward the panel 76 for the portion 81 and toward the panel 78 for the portion 82.

The vertical cut line starts from the bottom of the second, inner, blank 73, formed by the lid, and extends upward and, as can be seen, over a distance slightly greater for example by 1 to 2 mm than the height $\underline{h}$ of the outer blank.

FIG. 8 shows three exemplary vertical cuts 83, 84 and 85, namely a cut 83, in crosshead shape facing toward the outside from the center of the blank, a cut 84 in the form of a crosshead facing toward the inside, and a cut 85 in the shape of a T.

The crossheads or branch of the T are, for example, 1 to 2 mm long.

The main branch 86 of the bottom portion can be offset in relation to the third fold line 87, or situated (branch 88) in its extension (FIG. 10).

The chosen cutting mode, the width of the crossheads or of the bars of the T, are dependent on the packaging and the cardboard, the best positioning being found by trial and error in a manner within the scope of those skilled in the art, notably according to the thickness of the blanks and the basis weight of the papers used.

FIG. 11 shows another embodiment of a set 90 of blanks according to the invention, of the type of that described with reference to FIG. 7.

The bottom portions 91 of the third fold lines in this case are mashed or collapsed over a width b, for example of the order of 1 cm, and extend above the top edge of the external belt by a value i, for example equal to 5 mm.

Such collapsing is carried out in a manner known per se, and it is situated straddling the first facing fold line 69.

It may also be offset to the left or to the right as described with reference to the cuts of FIGS. 9 and 10.

FIG. 12 shows a fold 92 of corrugated cardboard illustrating, for those skilled in the art, the neutral fiber 93, which is situated two-thirds through a thickness E of the inner wall.

To ensure correct covering of two stacked blanks, those skilled in the art will then be led a priori to offset the fold lines of the outer blank, in relation to the corresponding fold lines of the inner blank, according to the thickness of the latter.

In fact, each fold line of the outer blank must be offset in succession by a third of the thickness of the inner blank, to which two-thirds of the thickness of the outer blank must be added, the dimensions being aggregated as the covering proceeds.

According to the invention, it is therefore very different therefrom as illustrated in the left-hand part of FIGS. 13 and 14, seen in cross section.

Here, the inner blank 94 is immobilized in relation to the outer blank 95 due to the bonding point 96.

More specifically, and as described in the embodiment of the invention more particularly described, the first outer blank 95, made of corrugated cardboard sheet material, comprises adjacent flaps 97 and 98 linked to each other by first fold lines 99 defined by their grooving (bottom line of the fold line).

The second inner blank 94 comprises panels 100, 101 linked to each other by third fold lines 102, the bottom portion of which is as defined hereinabove, for example, in this case with a cut 103.

Laid flat (FIG. 13), the panels 100, 101 of the second blank are respectively stacked on the part without flaps of the flaps 97, 98 of the first blank, the panel 101 being fixed to the flap 98 by bonding (point 96).

Since another non-adjacent flap (not represented) is also fixed by bonding to the other side of the flap 97, this prohibits the relative movement when folding or forming the box by winding the blanks around the mandrel 104.

The line 99 is substantially aligned with the line 102. There is therefore a slight offset d, of approximately six thicknesses of paper between the grooves 99 and 102.

For memory, the right-hand part of FIGS. 13 and 14 shows the conventional offset with slipping otherwise observed during free covering.

The width of the offset is then around $\frac{1}{3}\times E1+\frac{2}{3}\times E2$, with E1 and E2 giving the respective thicknesses of the second and first blanks.

In this case, if E1=3 mm and E2=1.5 mm, there is an offset of around 2 mm.

With the invention, the offset becomes 0.5 to 0.7 mm.

It goes without saying, and as a result of the foregoing, the present invention is not limited to the embodiments more particularly described. On the contrary, it encompasses all the variants and notably those in which there is both a collapsing and cutting of the bottom portions of the third fold lines and/or where all the bottom portions are mashed and/or cut.

The invention claimed is:

1. A set of blanks for forming a packaging box comprising two blanks made of cardboard sheet material, at least one of them being made of corrugated cardboard, namely a first blank including a first series of at least four main flaps terminated by a fixing tab, connected to one another by first fold lines parallel to one another and provided on one side with a series of flaps connected to said first series of main flaps by second fold lines perpendicular to said first fold lines and without flaps on the other side, said first series of flaps being designed to form the walls of the base of the packaging box and a second blank having bottom parts including a second series of at least four panels connected to one another by third fold lines parallel to one another, said second blank being designed to form the lid of said packaging box, the panels of the second blank having an edge without flaps being respectively stacked on the part without flaps of the main flaps of the first blank, wherein two non-adjacent flaps of the first blank are glued respectively to two opposite panels of the second blank, preventing the relative movement thereof when folding or forming the packaging box by winding said blanks around a volume of predetermined dimensions, and wherein at least two out of three of the third fold lines of the second blank are substantially aligned in relation to corresponding lines of the first fold lines of the first blank and each of the third fold lines is at an offset equal to or less than ½ of a thickness of the cardboard sheet material of the first blank in relation to its corresponding line of the first fold lines, one or more of said third lines including, in the bottom parts of the corresponding panels, a cut or collapsed portion opposite the corresponding first fold line.

2. The set of blanks as claimed in claim 1, wherein the two blanks are made of corrugated cardboard.

3. The set of blanks as claimed in claim 1, wherein a portion or portions that are substantially aligned with the first fold lines and situated opposite said first fold lines are cut.

4. The set of blanks as claimed in claim 3, wherein the cut or collapsed portion is crosshead-shaped.

5. The set of blanks as claimed in claim 3, wherein the cut or collapsed portion is T-shaped.

6. The set of blanks as claimed in claim 1, wherein the cut or collapsed portion is offset from the rest of its third fold line.

7. The set of blanks as claimed in claim 1, wherein, the thickness of the cardboard sheet material of the base being E1 and that of the cardboard sheet material of the lid being E2, the base being fixed to the outside of the lid, the cut or collapsed portion is cut and is offset from the rest of its third fold line by an amount equal to or less than half of/1;3 E1+⅔ E2.

8. The set of blanks as claimed in claim 1, wherein a portion or portions of the third fold lines that are substantially aligned with the first fold lines and situated opposite said first fold lines are collapsed.

9. The set of blanks as claimed in claim 8, wherein, the thickness of the cardboard sheet material of the base being E1 and that of the cardboard sheet material of the lid being E2, the collapsing is done over a width greater than 2×(E1+E2).

10. The set of blanks as claimed in claim 1, wherein the cut or collapsed portion extends beyond the edge without flaps of the first blank.

11. The set of blanks as claimed in claim 1, wherein the bottom edge of the second blank being opposite, or substantially opposite, the second fold lines, and wherein the cut or collapsed portion extends upward over a length greater than the height of the flaps of the first blank.

12. The set of blanks as claimed in claim 1, wherein the first blank has eight flaps, namely four main flaps separated from one another by intermediate flaps designed to form cut corners of the packaging box.

13. The set of blanks as claimed in claim 1, wherein said at least two out of three of the third fold lines of the second blank are substantially aligned with an offset equal to or less than 1 millimeter in relation to corresponding lines of the first fold lines of the first blank.

14. The set of blanks as claimed in claim 13, wherein the offset is equal to or between 0.5 and 0.7 millimeters.

15. A packaging box with polygonal section, formed from two blanks made of cardboard sheet material, at least one of which is made of corrugated cardboard, namely a first blank including a series of at least four main flaps terminated by a fixing tab, connected to one another by first fold lines parallel to one another, said series of flaps forming the walls of the base of the packaging box and being connected on one side to a series of flaps by second fold lines perpendicular to said first fold lines, said series of flaps forming the bottom of said packaging box, and a second blank having bottom parts including at least four panels connected to one another by a third fold line, said second blank forming the lid of said packaging box, the panels of the second blank having an edge without flaps being respectively stacked on the part without flaps of the main flaps of the first blank, wherein two non-adjacent flaps of the first blank are glued respectively to two opposite panels of the second blank, preventing the relative movement thereof when folding or forming the packaging box by winding said blanks around a volume of predetermined dimensions, and wherein at least two out of three of the third fold lines of the second blank are substantially aligned in relation to the first fold lines of the first blank and each of the third fold lines is at an offset equal to or less than ½ of a thickness of the cardboard sheet material of the first blank in relation to its corresponding line of the first fold lines, one or more of said third fold lines including in the bottom parts of the corresponding panels a cut or collapsed portion opposite the corresponding first fold line.

16. The packaging box as claimed in claim 15, wherein a portion or portions of the third fold lines that are substantially aligned with the first fold lines and situated opposite the first fold lines are cut.

17. The packaging box as claimed in claim 15, wherein the cut or collapsed portions are crosshead-shaped or T-shaped.

18. The packaging box as claimed in claim 15, wherein the cut or collapsed portion is offset from the rest its third fold line.

19. The packaging box as claimed in claim 18, wherein the cut or collapsed portion is offset from the rest of its third fold line along the order of 0.4 to 0.8 mm.

20. The packaging box as claimed in claim 15, wherein a portion or portions of the third fold lines that are substantially aligned with the first fold lines and situated opposite the first fold lines are collapsed.

21. The packaging box as claimed in claim 20, wherein the thickness of the cardboard sheet material of the base being E1 and that of the cardboard sheet material of the lid being E2, the collapsing is done over a width greater than 2×(E1+E2).

22. The packaging box as claimed in claim 15, wherein the cut or collapsed portion extends beyond the edge without flaps of the first blank.

23. The packaging box as claimed in claim 15, wherein the first blank has eight flaps, namely four main flaps separated from one another by intermediate flaps designed to form cut corners of the packaging box.

24. A method for producing a packaging box with polygonal section from two blanks made of corrugated cardboard sheet material, namely a first blank including a series of at least four main flaps terminated by a fixing tab, linked to one another by first fold lines parallel to one another, said series of main flaps forming the walls of the base of the packaging box and being connected on one side to a series of flaps by second fold lines perpendicular to said first fold lines, said series of flaps forming the bottom of said packaging box, and having no flaps on the other side, and a second blank having bottom parts including at least four panels connected to one another by third fold lines parallel to one another, said second blank forming a lid for said packaging box, wherein at least two out of three of the third fold lines of the second blank being substantially spaced apart by the same distances as those spacing apart the first fold lines of the first blank, one or more of said third fold lines are cut or collapsed in the bottom parts of the corresponding panels over a portion arranged to be positioned opposite the one or more corresponding first fold lines, two non-adjacent flaps or panels are glued, the second blank is placed on the first blank, or vice versa, such that the portion or portions of the one or more third fold lines that are cut or collapsed are substantially aligned in relation to its corresponding first fold line and each of the third fold lines is at an offset equal to or less than ½ of a thickness of the cardboard sheet material of the first blank in relation to its corresponding line of the first fold lines, and the packaging box is formed by winding the blanks around a predetermined volume, with no sliding of the second blank relative to the first blank, the portion or portions of the one or more third fold lines that are cut or collapsed allowing for the formation without tearing flaps and panels of the packaging box.

25. The method as claimed in claim 24, wherein the portion or portions of the one or more third fold lines that are cut or collapsed are formed in such a way that the portion or portions extend, after gluing, beyond an edge without flaps of the first blank.

26. The method as claimed in claim 24, wherein a cut is produced in the portion or portions of the one or more third fold lines that are cut or collapsed, the cut being in the shape of a crosshead or in the shape of a T.

27. The method as claimed in claim 24, wherein the portion or portions of the one or more third fold lines that are cut or collapsed are offset from the rest of its third fold line on the order of 0.4 to 0.8 mm.

28. The method as claimed in claim 24, wherein the portion or portions of the one or more third fold lines that are cut or collapsed are collapsed.

29. The method as claimed in claim 28, wherein the portion or portions of the one or more third fold lines that are cut or collapsed are collapsed over a width of approximately 10 mm.

* * * * *

UNITED STATES PATENT AND TRADEMARK OFFICE

CERTIFICATE OF CORRECTION

PATENT NO. : 8,777,097 B2
APPLICATION NO. : 12/679802
DATED : July 15, 2014
INVENTOR(S) : Sébastien Jacomelli et al.

It is certified that error appears in the above-identified patent and that said Letters Patent is hereby corrected as shown below:

IN THE CLAIMS:

Column 11; Claim 18; Line 56:
Please delete "the rest" and insert --the rest of--

Signed and Sealed this
Twentieth Day of January, 2015

Michelle K. Lee

Michelle K. Lee
*Deputy Director of the United States Patent and Trademark Office*